US006226482B1

(12) United States Patent
Christy et al.

(10) Patent No.: US 6,226,482 B1
(45) Date of Patent: May 1, 2001

(54) MULTI-ROLLER MONOCOMPONENT TONER APPLICATOR

(75) Inventors: Orrin Christy, North Tonawanda; Dan Kanfoush, Niagara Falls; Alan Murzynowski, Grand Island; Leo Swanson, Niagara Falls, all of NY (US)

(73) Assignee: Moore U.S.A., Inc., Grand Island, NY (US)

( * ) Notice: Subject to any disclaimer, the term of this patent is extended or adjusted under 35 U.S.C. 154(b) by 0 days.

(21) Appl. No.: 09/481,712

(22) Filed: Jan. 12, 2000

(51) Int. Cl.[7] ..... G03G 15/08

(52) U.S. Cl. ..... 399/252; 399/281; 399/285; 399/292; 430/120

(58) Field of Search ..... 399/292, 293, 399/252, 279, 281, 285; 430/120

(56) References Cited

U.S. PATENT DOCUMENTS

| | | | |
|---|---|---|---|
| 3,572,922 | 3/1971 | Olden . | |
| 5,012,285 | 4/1991 | Oka et al. . | |
| 5,329,340 | 7/1994 | Fukuchi et al. . | |
| 5,424,817 | 6/1995 | Imamiya et al. . | |
| 5,465,139 | 11/1995 | Kimura et al. . | |
| 5,510,883 | 4/1996 | Kimura et al. . | |
| 5,532,100 | 7/1996 | Christy et al. . | |
| 5,617,190 * | 4/1997 | Takenaka et al. | 399/159 |
| 5,623,717 | 4/1997 | Takenaka et al. . | |
| 5,633,108 | 5/1997 | Christy et al. . | |
| 5,656,409 | 8/1997 | Christy et al. . | |
| 5,666,625 | 9/1997 | Komatsubara et al. . | |
| 5,790,929 | 8/1998 | Goto et al. . | |

* cited by examiner

*Primary Examiner*—Richard Moses
(74) *Attorney, Agent, or Firm*—Nixon & Vanderhye P.C.

(57) ABSTRACT

A system and method for applying electrically charged non-magnetic toner to an image device, and subsequently to a moving substrate, provides precise level control, proper control of the electrical charge of the toner, minimization of dusting problems, and maximum evenness of the toner layer. First and second fluidized toner beds have the toner in them charged using corona sources. The second bed maintains a level of toner above the level in the first bed, and a spillway-defining restraining dam is disposed between the beds so that the toner above the level desired in the second bed spills over the restraining dam into the first bed, allowing very precise control of the level of toner in the second bed. Toner transfer mechanisms (such as rotating conductive cylinders) transfer toner from the first bed to the second bed, and from the second bed to the image device. Scrapers scrape excess toner from the rotating cylinders so that it falls back into either the first or second bed.

21 Claims, 1 Drawing Sheet

MULTI-ROLLER MONOCOMPONENT TONER APPLICATOR

BACKGROUND AND SUMMARY OF THE INVENTION

Conventional systems for applying electrically charged non-magnetic toner to substrates, such as shown in U.S. Pat. Nos. 5,633,108, 5,656,409, and 5,532,100 (the disclosures of which are hereby incorporated by reference herein) provide a number of advantages compared to conventional constructions and methods for applying toner to substrates. Typically, a single toner bed is maintained in a fluidized state, with a toner level sensor using a feedback circuit controlling a replenishment system. While the present system and method are highly advantageous, there are some problems associated therewith which desirably should be overcome, and are overcome utilizing the system and method of the present invention.

One of the problems of the conventional system is the level control. The sensor and feedback group construction can guarantee an accuracy of only ±0.02 inches. A deviation this large causes a cyclic change in output print density. Also, the present system experiences problems with level control and start-up and emergency stoppages, which can cause downtime and operator frustration.

The second problem with the present system is the existence of wrong sign toner. That is negatively charged toner particles can collect in the sole toner bed, disrupting the flow in the bed and causing electrical field charges in the unit. Then the print quality can drift because of this, and more frequent maintenance intervals are needed.

The third problem with conventional systems is dusting. Because of conventional delivery roller system geometry, a high amount of vacuum cleaning is needed. This disrupts the air management within the unit and can cause level fluctuations, and unexpected toner vectoring at the ends of the rollers.

The fourth problem with conventional systems is an uneven toner layer. In the present system and method it is difficult to properly control the consistency and thickness of the toner layer so as to insure uniform application of toner to the substrate.

According to the present invention a system and method are provided which overcome the above problems. The invention utilizes a dual bed system, with a supply bed and a feeder bed at different levels (additional beds may also be used). Three (or more) system rollers are utilized, in addition to the image cylinder, to transport charged toner from one bed to the next, and upwardly away from the bed to the image cylinder. Toner polarity filtration is maximized as the toner is lifted and transferred into the feeder bed. Essentially absolute toner level control (an accuracy of better than 0.01 inches) is provided in the feeder bed using a dam spillway system, and improved toner scatter control is provided using an over/under configuration of toner delivery rollers.

According to a first aspect of the present invention a system for applying electrically charged non-magnetic toner to an image device (and then subsequently to a substrate) is provided. The system comprises or consists essentially of the following components: A first fluidized toner bed having electrically charged non-magnetic toner maintained at substantially a first level therein. A first corona source disposed in the first bed for electrically charging toner in the first bed. A second fluidized toner bed adjacent the first bed and having toner maintained at substantially a second level therein, different than the first level. A second corona source disposed in the second bed for electrically charging toner in the second bed. An image device. A first toner transfer mechanism maintained at a first electrical bias for transferring toner from the first bed to the second bed. And a second toner transfer mechanism maintained at a second electrical bias different than the first bias for transferring toner from the second bed to the image device, the image device maintained at a third electrical bias different than the first and second biases.

The first toner transfer mechanism may comprise a first conductive roller rotatable in a first direction, although other transfer mechanisms may be utilized, such as a pneumatic toner lifting chute. A second toner transfer mechanism preferably comprises a second conductive roller rotatable in a first direction and operatively engaging the first conductive roller. Also, the second toner transfer mechanism typically further comprises an opposing roller above the axis of rotation of the second roller and operatively engaging the second conductive roller and rotatable in a second direction opposite the first direction, the opposing roller operatively engaging the image device. Typically the image device comprises an image roller rotatable in the first direction.

Preferably the second level of toner is maintained in the second bed by a spillway-defining restraining dam disposed between the first and second beds so that the toner above the second level spills over the restraining dam into the first bed, although any conventional structure for that purpose (and preferably with an accuracy of 0.01 inches is the maximum level) may be utilized. A single toner replenishment device is preferably provided for replenishing the first bed with toner when the level of toner therein falls below the first level. While a single replenishment device is preferably provided, it may have multiple discharges into the first toner bed if desired.

The system may further comprise a first scraper for scraping excess toner from said first conductive roller so that the scraped toner falls back into said first bed; a second scraper for scraping excess toner from the second conductive roller so that the scraped toner falls back into the second bed; and a third scraper for scraping excess toner from the opposing roller so that the scraped toner falls back into the second bed. The first and second corona devices may comprise corona wires, spiked rotating wheels, or any other conventional constructions. In one preferred embodiment, the first electrical bias is between about 600–1200+ volts (e.g. about 800+ volts), the second electrical bias is between about 100–500+ volts (e.g. about 400+ volts), the opposing rollers are substantially at above ground potential, and the third electrical bias is a negative bias, so the toner transfers electrostatically from the first conductive roller to the second conductive roller to the opposing roller and to the image device.

According to another aspect of the present invention a method of applying conductive non-magnetic toner to a moving substrate using first, second, opposing, and image conductive rotating cylinders (rollers) with the axis of rotation of the opposing cylinder above those of the first ands second cylinders, and the axis of rotation of the image cylinder above that of the opposing cylinder, each cylinder having a peripheral surface, is provided. The method comprises: (a) Biasing the first conductive cylinder to a first electrical bias, and rotating it in a first direction so that conductive non-magnetic toner is attracted to the peripheral surface thereof. (b) Biasing the second conductive cylinder to a second electrical bias different than the first bias and rotating it in the first direction, so that conductive non-magnetic toner is transferred from the first cylinder to the second cylinder. (c) Biasing the image cylinder to a third electrical bias different than the first and second biases, and rotating it in the first direction so that conductive non-magnetic toner is transferred from the opposing cylinder to the image cylinder. (d) Biasing the opposing cylinder to a fourth electrical bias different than the first, second, and third biases, and rotating it in a second direction opposite the first direction, so that conductive non-magnetic toner is transferred from the second cylinder to the opposing cylinder. And (e) transferring the toner from the image cylinder to a moving substrate to form images on the substrate.

Preferably, (a)–(d) are practiced so that the first electrical bias is about 600–1200+ volts, the second electrical bias is about 100–500+ volts, the fourth electrical bias is substantially at about ground potential, and the third electrical bias is a negative bias. The method may further be practiced utilizing first and second beds of toner, and then preferably (a) is practiced by transferring toner from the first bed to the first cylinder, and (b) is practiced by scraping toner from the second cylinder so that it is deposited in the second bed, and then transferring toner from the second bed to the second cylinder; and further comprising (f) scraping excess toner from the opposing cylinder so that it falls into the second bed. The method may further comprise (g) electrically charging the conductive non-magnetic toner in the first and second beds using corona devices; (h) maintaining the maximum level of toner in the second bed with an accuracy of 0.01 inches or better; and (i) replenishing the toner in the first bed when it falls below a predetermined level. Preferably, (h) is practiced by providing a spillway defined by a restraining dam between the first and second beds so that any excess toner in the second bed spills over into the first bed.

The invention further comprises a method of applying electrically conductive nonmagnetic toner to a moving substrate using first and second toner beds, and an image device comprising or consisting essentially of: (a) Replenishing the electrically conductive non-magnetic toner in the first bed when it falls below a predetermined level. (b) Transferring toner from the first bed to the second bed. (c) Maintaining the maximum level of toner in the second bed with an accuracy of 0.01 inches or better. (d) Transferring toner from the second bed to the image device to provide a substantially even toner layer on the image device. And (e) transferring toner from the image device to a moving substrate. Typically, (c) is practiced by providing a spillway defined by a restraining dam between the first and second beds so that any excess toner spills over from the second bed into the first bed. Also, the method further comprises maintaining the first and second toner beds as fluidized beds, and electrically charging the toner in the first and second fluidized beds.

It is the primary object of the present invention to provide an advantageous system and method for applying electrically charged non-magnetic toner to an image device, and subsequently to a substrate. This and other objects of the invention will become clear from an inspection from the detailed description of the invention and from the appended claims.

DETAILED DESCRIPTION OF THE DRAWING

Figure 1:
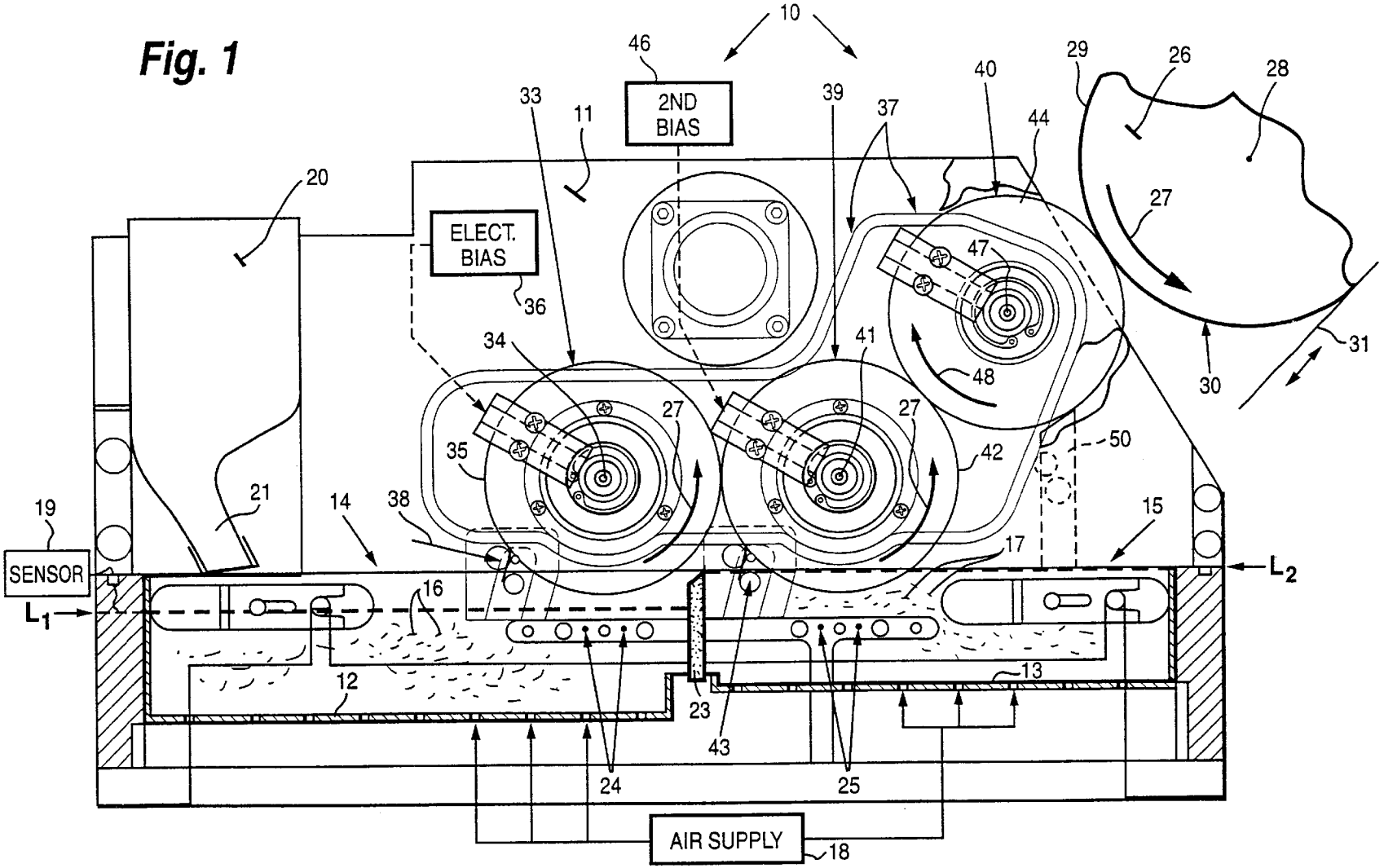
FIG. 1 is a side schematic view, partly in cross section and partly in elevation, and with some parts cut away for clarity of illustration, of an exemplary system according to the present invention, for practicing the method according to the invention, for applying electrically charged non-magnetic toner to a substrate.

FIG. 1 schematically illustrates an exemplary system, shown generally by reference numeral 10, according to the present invention. In the embodiment illustrated a common housing 11 is provided for mounting all of the components, although multiple housings could be utilized instead.

The housing 11, at the bottom thereof, defines—along with non-conductive porous plates 12, 13—first and second fluidized beds shown generally by reference numerals 14 and 15 in FIG. 1. Air for fluidizing the conductive non-magnetic toner—shown schematically by reference numeral 16 in bed 14, and 17 in bed 15—is supported by a conventional pressurized air plenum connected up to a conventional pressurized air supply shown schematically at 18 in FIG. 1. The toner 16 in the first bed 14, which acts as a supply sump, is maintained at a first level $L_1$, while the toner 17 in the second bed 15, which acts as a constant level feeder bed, is maintained at a level $L_2$.

The level control for the level $L_1$ may be provided by any conventional sensing and supply system. For example, a conventional acoustic level sensing system, shown schematically at 19 in FIG. 1, may be provided for sensing the level $L_1$, and a conventional toner replenishment system, shown schematically at 20 in FIG. 1, may be provided operated in response to the sensing by the sensor 19. Preferably a single toner replenishment device 20 is provided, although it may have a plurality of chutes 21 (each controlled by a valve type mechanism, or other conventional construction) to deposit new toner into the first bed 14 when the level of toner 16 drops below the desired level $L_1$.

Because conventional level control systems for the first bed 14 typically have an accuracy of only about ±0.02 inches, a cyclic change in output print density may result if the first bed 14 is used as a feeder bed. However, by using the precisely leveled control feeder bed 15 this problem is eliminated, and other problems are minimized. The second bed 15 has a highly accurate control of level $L_2$, which is preferably provided—as illustrated in FIG. 1—by a spillway-defining restraining dam 23 disposed between the beds 14, 15 so that toner above the second level $L_2$ spills over the dam 23 into the first bed 14. In this way level control of the level $L_2$ of 0.01 inches or better may be provided.

The toner particles 16, 17 are charged in the beds 14, 15 using first and second corona sources—shown schematically by reference numerals 24, 25, respectively. In the illustration in FIG. 1 the corona sources 24, 25 are illustrated as conventional corona wires. However, it is to be understood that any conventional corona source may be provided for electrically charging the toner in the beds 14, 15, including rotating spiked rollers, loops, or the like. In the preferred embodiment the toner in both beds 14, 15 is positively charged.

The system 10 further comprises an image device, preferably an image roller 26 rotatable in the first direction 27 about an axis 28, and having a peripheral surface 29 on which a substantially even level of toner 30 forms for transfer to a moving substrate 31 (typically a web or sheet of paper). The image cylinder 26 is rotated in the direction 27 by any conventional motor, gear train, or like conventional structure.

The system 10 further comprises a first toner transfer mechanism, such as the first conductive roller (cylinder) shown generally by reference numeral 33 in FIG. 1. While other transfer mechanisms (including a pneumatic lifting chute) could be utilized, the roller 33 is preferred. The roller 33 is rotatable about an axis 34 (parallel to and preferably below the axis 28) in the first direction 27 by any suitable conventional rotating structure (such as a motor or gear train), and has a peripheral surface 35 thereof which preferably is just above the level $L_1$ of toner particle 16 in the first bed 14. The roller 33 is maintained at a first electrical bias, e.g. by any suitable electrical connection such as illustrated schematically at 36 in FIG. 1. For example, the electrical bias provided by 36 for the peripheral surface 35 of the roller 33 may be between about 600–1200+volts (e.g. about 800+ volts).

Toner particles which are electrostatically transferred to the peripheral surface 35 of the first roller 33 are ultimately transferred to a second toner transfer mechanism, illustrated schematically at 37 in FIG. 1. Any excess toner on the peripheral surface 35 that does not get transferred to the second transfer mechanism 37 is scraped off by a conventional scraper 38, and falls into the first bed 14.

While a wide variety of structures may be utilized for the transfer mechanism 37, in the preferred embodiment the transfer mechanism 37 comprises a second conductive roller 39 and an opposing (cylinder) 40. The second roller 39 is rotatable about an axis 41 which is parallel to the axes 28, 34, and at substantially the same vertical level as the axis 34, and rotates in the first direction 27 again powered by any suitable conventional mechanism. Toner is transferred to the peripheral surface 42 of the roller 39 from the first roller 33, and then is scraped off by the conventional scraper 43 and falls into the second bed 15. Then the peripheral surface 42 continues into the second fluidized bed 15, and toner again is formed on the peripheral surface 42 thereof and then is electrostatically transferred to the peripheral surface 44 of the opposing roller 40. Any toner not transferred to the opposing roller 40 is ultimately scraped off by the scraper 43 and falls into the bed 15.

The second conductive roller 39 is maintained at a second electrical bias, by any suitable conventional electric potential applying device, such as illustrated schematically at 46 in FIG. 1—which is different than the first bias applied by the source 36. For example, the second bias may be between about 100–500+ volts (e.g. about 400+ volts) to facilitate electrostatic transfer of toner.

The opposing roller 40 is rotatable about an axis of rotation 47 which is parallel to the axes 28, 34, 41, and preferably located about the axis 41, and preferably below axis 28. Typically the peripheral surface 44 of the roller 40 is above the axis 41 so that the charged toner transferred from surface 42 to surface 44 moves to a higher level, away from the second bed 15. The roller/cylinder 40 is rotated in a second direction 48, opposite the first direction 27, and the roller 40 is maintained at a different electrical bias (potential) than the rollers 33, 39. For example, in exemplary embodiment the roller 40 is maintained substantially at ground potential.

Toner from the peripheral surface 42 is electrostatically transferred to the peripheral surface 44, and then ultimately from the surface 44 to the peripheral surface 29 of the image cylinder 26. Any excess toner that is not transferred is then scraped off suface 44 by the conventional scraper 50, and falls into the second bed 15. Preferably, the image cylinder 26—in the embodiment described above—is maintained at a negative bias/potential, e.g. −100 to −400 volts, which facilitates transfer of toner thereto.

Thus, according to one method of the present invention, a first conductive cylinder 33 is biased to a first electrical bias (e.g. +800 volts) and rotated in the first direction 27 so that nonconductive, non-magnetic toner 16, from the first reservoir 14 is attracted to the peripheral surface 35 thereof. The second roller 39 is biased to a second electrical bias (e.g. +400 volts) different than the first bias and is rotated in the first direction 27, so that conductive non-magnetic toner is transferred from the first cylinder 33 to the second cylinder 39. The conductive non-magnetic toner is then scraped off by the scraper 43 into the reservoir 15, and then toner is picked up from the reservoir 15 by the peripheral surface 42 of the roller 39 and electrostatically transferred to the third roller peripheral surface 44. The third roller 40 is rotated in the second direction 49 and maintained at a different electrical bias (e.g. ground). The image cylinder 26 is biased to a third electrical bias (e.g. a negative bias), and toner is electrostatically transferred from the peripheral surface 44 to the peripheral surface 29.

In the practice of the method, the toner 16 in the first bed 14 is replenished when it falls below the predetermined level $L_1$ as sensed by the sensor 19 which operates the replenishment reservoir 20. Toner is transferred from the first bed 14 to the second bed 15 at a rate to ensure that the second bed 15 is always substantially full of toner, and the maximum level of toner $L_2$ is maintained in the second bed 15 with an accuracy of 0.01 inches or better. Toner is transferred from the second bed 15 to the image device 26 to provide a substantially even toner level 30 on the image device 26, for uniform print density and transfer to the moving substrate 31.

Utilizing the system 10, and the method of operation thereof as described above, deviation in level control which causes a cyclic change in print density as existed in the prior art is eliminated. Also, negatively charged toner particles which might collect in the reservoir 14 are not transferred to the reservoir 15, and therefore print quality drifting is minimized, and maintenance intervals extended. Also, a high level of vacuum cleaning is not necessary, and level fluctuations and unexpected toner vectoring are minimized thereby minimizing dusting problems. Also, the toner layer thickness 30 is maintained substantially uniform.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent systems and methods.

What is claimed is:

1. A system for applying electrically charged non-magnetic toner to an image device, comprising:

a first fluidized toner bed having electrically charged non-magnetic toner maintained at substantially a first level therein;

a first corona source disposed in said first bed for electrically charging toner in said first bed;

a second fluidized toner bed adjacent said first bed and having toner maintained at substantially a second level therein, different than said first level;

a second corona source disposed in said second bed for electrically charging toner in said second bed;

an image device;

a first toner transfer mechanism maintained at a first electrical bias for transferring toner from said first bed to said second bed; and a second toner transfer mechanism maintained at a second electrical bias different than said first bias for transferring toner from said second bed to said image device, said image device maintained at a third electrical bias different than said first and second biases.

2. A system as recited in claim 1 wherein said first toner transfer mechanism comprises a first conductive roller rotatable in a first direction.

3. A system as recited in claim 2 wherein said second toner transfer mechanism comprises a second conductive roller rotatable in said first direction and operatively engaging said first conductive roller.

4. A system as recited in claim 3 wherein said second toner transfer mechanism further comprises an opposing roller above the axis of rotation of the second roller and operatively engaging said second conductive roller and rotatable in a second direction opposite said first direction, said opposing roller operatively engaging said image device.

5. A system as recited in claim 4 wherein said image device comprises an image roller rotatable in said first direction, about an axis above said image roller axis.

6. A system as recited in claim 5 wherein said second level of toner is maintained in said second bed by a spillway-defining restraining dam disposed between said first and second beds so that toner above said second level spills over said restraining dam into said first bed.

7. A system as recited in claim 6 further comprising a single toner replenishment device for replenishing said first bed with toner when the level of toner therein falls below said first level.

8. A system as recited in claim 4 further comprising a first scraper for scraping excess toner from said first conductive roller so that the scraped toner falls back into said first bed; a second scraper for scraping excess toner from said second conductive roller so that the scraped toner falls back into said second bed; and a third scraper for scraping excess toner from said opposing roller so that the scraped toner falls back into said second bed.

9. A system as recited in claim 8 wherein said first and second corona devices comprise corona wires.

10. A system as recited in claim 8 wherein said first electrical bias is about 600–1200+ volts, said second electrical bias is about 100–500+ volts, said opposing roller is substantially at about ground potential, and said third electrical bias is negative, so that toner transfers electrostatically from said first conductive roller to said second conductive roller to said opposing roller to said image device.

11. A system as recited in claim 1 wherein said second level of toner is maintained in said second bed by a spillway-defining restraining dam disposed between said first and second beds so that toner above said second level spills over said restraining dam into said first bed.

12. A system as recited in claim 11 further comprising a single toner replenishment device for replenishing said first bed with toner when the level of toner therein falls below said first level.

13. A system as recited in claim 1 further comprising a single toner replenishment device for replenishing said first bed with toner when the level of toner therein falls below said first level.

14. A method of applying conductive non-magnetic toner to a moving substrate using first, second, opposing, and image conductive rotating cylinders, with the axis of rotation of the opposing cylinder above those of the first ands second cylinders, and the axis of rotation of the image cylinder above that of the opposing cylinder, each cylinder having a peripheral surface, comprising:

(a) biasing the first conductive cylinder to a first electrical bias, and rotating it in a first direction so that conductive non-magnetic toner is attracted to the peripheral surface thereof;

(b) biasing the second conductive cylinder to a second electrical bias different than the first bias and rotating it in the first direction, so that conductive non-magnetic toner is transferred from the first cylinder to the second cylinder;

(c) biasing the image cylinder to a third electrical bias different than the first and second biases, and rotating it in the first direction so that conductive non-magnetic toner is transferred from the opposing cylinder to the image cylinder;

(d) biasing the opposing cylinder to a fourth electrical bias different than the first, second, and third biases, and rotating it in a second direction opposite the first direction, so that conductive non-magnetic toner is transferred from the second cylinder to the opposing cylinder; and (e) transferring the toner from the image cylinder to a moving substrate to form images on the substrate.

15. A method as recited in claim 14 wherein (a)–(d) are practiced so that the first electrical bias is about 600–1200+ volts, the second electrical bias is about 100–500+ volts, the fourth electrical bias is substantially at about ground potential, and the third electrical bias is a negative bias.

16. A method as recited in claim 14 further utilizing first and second beds of toner; and wherein (a) is practiced by transferring toner from the first bed to the first cylinder, and (b) is practiced by scraping toner from the second cylinder so that it is deposited in the second bed, and then transferring toner from the second bed to the second cylinder; and further comprising (f) scraping excess toner from the opposing cylinder so that it falls into the second bed.

17. A method as recited in claim 16 further comprising: (g) electrically charging the conductive non-magnetic toner in the first and second beds using corona devices; (h) maintaining the maximum level of toner in the second bed with an accuracy of 0.01 inches or better; and (i) replenishing the toner in the first bed when it falls below a predetermined level.

18. A method as recited in claim 17 wherein (h) is practiced by providing a spillway defined by a restraining dam between the first and second beds so that any excess toner spills over into the first bed.

19. A method of applying electrically conductive non-magnetic toner to a moving substrate using first and second toner beds, and an image device, comprising:

(a) replenishing the electrically conductive non-magnetic toner in the first bed when it falls below a predetermined level;

(b) transferring toner from the first bed to the second bed;

(c) maintaining the maximum level of toner in the second bed with an accuracy of 0.01 inches or better;

(d) transferring toner from the second bed to the image device to provide a substantially even toner layer on the image device; and (e) transferring toner from the image device to a moving substrate.

20. A method as recited in claim 19 wherein (c) is practiced by providing a spillway defined by a restraining dam between the first and second beds so that any excess toner spills over into the first bed.

21. A method as recited in claim 20 further comprising maintaining the first and second toner beds as fluidized beds, and electrically charging the toner in the first and second fluidized beds.

* * * * *